United States Patent [19]

Phelan

[11] Patent Number: 4,962,007

[45] Date of Patent: Oct. 9, 1990

[54] FLUTE TUBING OF LAMINATED METAL INCLUDING A BONDED LAYER OF PRECIOUS METAL ALLOY

[75] Inventor: John J. Phelan, Stoneham, Mass.

[73] Assignee: Verne Q. Powell Flutes, Inc., Waltham, Mass.

[21] Appl. No.: 437,773

[22] Filed: Nov. 15, 1989

Related U.S. Application Data

[63] Continuation of Ser. No. 258,077, Oct. 14, 1988, abandoned, which is a continuation of Ser. No. 25,616, Mar. 13, 1987, abandoned.

[51] Int. Cl.[5] ..... G10D 7/02

[52] U.S. Cl. ..... 428/670; 428/672; 428/673; 84/384

[58] Field of Search ..... 428/670, 672, 673, 669; 84/384, 352 R; 138/142, 143

[56] References Cited

U.S. PATENT DOCUMENTS

| | | | |
|---|---|---|---|
| 422,647 | 3/1890 | Smith | 428/672 |
| 440,693 | 11/1890 | Burdon | 428/672 |
| 440,694 | 11/1890 | Burdon | 428/672 |
| 685,653 | 10/1901 | Stafford | 428/672 |
| 968,694 | 8/1910 | Rubright . | |
| 1,119,954 | 12/1914 | Haynes . | |
| 1,715,162 | 5/1929 | Haynes . | |
| 1,801,187 | 4/1931 | Artley et al. . | |
| 1,801,690 | 4/1931 | Pruefer . | |
| 1,809,380 | 6/1931 | Gulick . | |
| 2,219,434 | 10/1940 | White | 428/673 |
| 3,487,742 | 1/1970 | Mills | 84/384 |
| 3,643,538 | 2/1972 | Toyama | 84/389 |
| 3,805,665 | 4/1974 | Oouchi | 84/380 |
| 4,306,484 | 12/1981 | Toyama | 84/380 R |

FOREIGN PATENT DOCUMENTS

| | | | |
|---|---|---|---|
| 56-81644 | 7/1981 | Japan | 428/670 |
| 56-81645 | 7/1981 | Japan | 428/672 |
| 56-81647 | 7/1981 | Japan | 428/670 |
| 24483 | of 1914 | United Kingdom . | |

OTHER PUBLICATIONS

James Phelan & Mitchell D. Brody, The Complete Guide to the Flute, Boston Mass.: Conservatory Publications, 1980), pp. 10–15, 20–21, 26–28, 33–34.

Laura E. Gilliam & William Lichtenwanger, The Dayton C. Miller Collection–A Checklist of the Instruments (Washington, DC: Library of Congress, 1961), p. 46.

Philip Bate, *The Flute,* (2d ed. 1979) (London: Ernest Benn: and New York: W. W. Norton), pp. 3, 9–10, 95–97, FIGS. 24–25, 130–131, 196–197, 205–206, 208–209, 217, 219, 220 and n. 4, Plates 7,8,9.

Roger Mather, "The Choice of Flute Tube Material and Thickness," Apr. 1974, *Woodwind World* (Oneonta , N.Y.: Swift-Dorr Publications, Inc.), pp. 24–27; continued in Jun. 1974, Woodwind World, pp. 19–21, 27–28.

"Notes etc." (Coralville, Iowa: Miyazawa Flutes U.S.A.) Aug. 1986, issue, p. 5.

D. Smithers, K. Wogram and J. Bowsher, "Playing the Baroque Trumpet," *Scientific American,* Apr. 1986 issue, pp. 108–115.

American Society for Metals, Metals Handbook, vol. 2, pp. 659–705, 836–837, 853–854 (9th ed. 1979).

*Primary Examiner*—John J. Zimmerman

*Attorney, Agent, or Firm*—Nutter, McClennen & Fish

[57] ABSTRACT

A musical instrument (for example, a flute) or a musical instrument segment (for example, a flute headjoint) having tubing made of a mechanically unitary laminated metal tube which has at least one layer of precious metal alloy bonded to another layer of metal alloy.

21 Claims, 1 Drawing Sheet

FLUTE TUBING OF LAMINATED METAL INCLUDING A BONDED LAYER OF PRECIOUS METAL ALLOY

This application is a continuation of Ser. No. 07/258,077, filed Oct. 14, 1988, now abandoned, which was itself a continuation of Ser. No. 07/025,616, filed Mar. 13, 1987, also abandoned.

BACKGROUND OF THE INVENTION

1. Field of the Invention

This invention relates generally to the field of musical instruments which include a tubular segment and, more specifically, to flutes and segments thereof.

2. Description of the Prior Art

Making a high quality flute requires accommodating several sometimes-conflicting goals. A high quality flute must produce an excellent tone, be easily played, and be pleasing to the eye. A high quality flute also should not be excessively costly to make.

Although the quality of a flute depends largely on the skill of its maker, it also depends to a significant extent on the materials o which the flute is made.

Modern flutes have three generally tubular segments: a headjoint, a center joint, and a foot joint, each made of metal tubing. The flute may be disassembled into these three segments for convenient storage (in a case, for example) and transportation. The tone quality of the flute is strongly influenced by the quality of the headjoint.

The tone quality of a flute is improved by making the tubing of its segments from a dense and hard metal. Precious metals, in their commonly-used alloys (such as sterling silver or 14-carat gold) are dense and can be hardened. A high quality modern flute typically has tubing made of a uniform alloy of either silver, gold, or platinum, each of which is a precious metal. The tubing is formed by drawing a sheet of the uniform alloy into a cylindrical form.

Many professional musicians believe that flutes with silver alloy tubing produce a bright tone. They believe that flutes with gold alloy tubing produce tones that are warmer, sweeter, and richer than tones produced by flutes with silver alloy tubing. While some musicians prefer platinum flutes, others believe that platinum flutes produce a "cold" or "hard" tone.

A high quality flute should enable a player easily to produce a pleasing tone. When a flute player tries to use higher wind velocity to produce a louder tone, the tone quality produced by many headjoints deteriorates—a condition which professional flute players call "overblowing" the flute. A headjoint should resist "overblowing." Headjoints made of uniform platinum alloy tubing are particularly resistant to "overblowing."

Some owners of flutes with sterling silver tubing have those flutes electroplated with gold, either to achieve the appearance of a gold finish or to avoid the tendency of a sterling silver surface to tarnish. In addition, several flute manufacturers sell silver flutes which have been plated with gold. However, gold plating does not perceptibly improve the tone quality of the instrument and, since it cannot be work-hardened, may even detract from the tone quality. Also, a plated layer is relatively soft and is prone to wearing off.

The difficulty of achieving an acceptable balance among the foregoing considerations has frustrated both flute players and flute makers. Current flutes do not satisfy the demands of flute players for high-quality, relatively inexpensive instruments. As a result, many flute players have had to make an uneasy compromise between their need for high-quality instruments and their ability to pay for expensive gold or platinum flutes.

SUMMARY OF THE INVENTION

The invention provides a new and improved flute or flute segment (particularly a headjoint) having tubing made of a laminated metal with at least two bonded layers, at least one of which is of precious metal alloy. The bonded layer of precious metal alloy is bonded to an adjacent layer which may be of precious or base metal alloy. The tubing may have more than two bonded layers.

In brief summary, the flute or flute headjoint is formed of laminated metal tubing having two bonded layers: an outer layer of silver alloy and an inner layer of gold alloy. The laminated metal tubing is made by drawing into tubular form a laminated metal disk having a layer of silver alloy and a layer of gold alloy so that the silver becomes the outer layer of the tubing and the gold becomes the inner layer of the tubing. The laminated metal disk is made by laminating together separate disks of each alloy, using a bonding agent such as silver solder to bond the layers together.

The new flute or flute headjoint meets the need described above for a new material for flute tubing. The laminated metal tubing is much less expensive than tubing of a traditional, non-laminated, uniform gold alloy or platinum alloy because silver alloy is much less expensive than either the gold or platinum alloys. The laminated metal tubing can be worked like the traditional tubing of uniform gold, silver, or platinum alloy. Moreover, when played with a center joint and a foot joint made from traditional, non-laminated, uniform gold alloy or silver alloy tubing, a flute headjoint made from the new laminated metal tubing produces excellent tone quality.

DESCRIPTION OF THE DRAWINGS

The invention is pointed out with particularity in the appended claims. The above and further advantages of the invention may be better understood by referring to the following description taken in conjunction with the accompanying drawings, in which:

DETAILED DESCRIPTION OF THE PREFERRED EMBODIMENT

Figure 1:
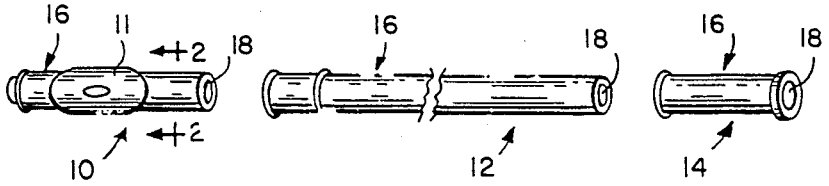
FIG. 1 is a simplified, exploded view of a portion of a metal flute made according to the invention, showing a headjoint with an embouchure plate and its breath hole and showing the center joint and the foot joint but without their keys or tone holes.

FIG. 1 depicts the three segments of a modern metal flute, including a headjoint 10, a center joint 12, and a foot joint 14, which may be assembled to form a complete flute for playing. The headjoint 10 is shown with an embouchure plate 11 with its breath hole, which are added to the headjoint tubing during manufacture of the headjoint. As is well known in the art of making flute headjoints, a high-quality flute headjoint 10 is usually slightly tapered and has a diameter which generally tends to decrease with increasing distance along the longitudinal axis of the headjoint from the point of attachment to the middle joint. This tapering is not shown in FIG. 1. The center joint 12 and the foot joint 14 are shown without keys or tone holes, which are also added during manufacture of the flute. The center joint 12 and the foot joint 14 are usually substantially cylindrical. Each of the headjoint 10, the center joint 12, and the foot joint 14 has an outer surface 16 and an inner surface 18.

Figure 2:
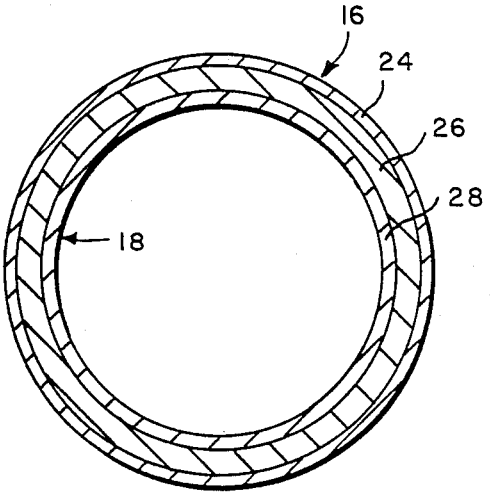
FIG. 2 is a cross-sectional view along the line 2—2 shown in FIG. 1 depicting a headjoint made from a unitary laminated metal tube having three bonded layers.

FIG. 2 depicts a cross-sectional view of the tubing of the headjoint 10 (without the embouchure plate 11 or its breath hole) of the flute shown in FIG. 1 taken along the line 2—2 shown in FIG. 1 and perpendicular to the longitudinal axis of the headjoint tubing. The headjoint tubing 10 has three layers, namely, an outer layer 24, a middle layer 26, and an inner layer 28, which are bonded together. The outer surface of the outer layer 24 forms the outer surface 16 of the headjoint, and the inner surface of inner layer 28 forms the inner surface 18 of the headjoint.

FIG. 2 also depicts a cross-sectional view of the substantially cylindrical mechanically unitary laminated metal tube from which a headjoint, according to my invention, is made. Before the tapering process, such a mechanically unitary laminated tube has an outer diameter of approximately 0.775 inches and an inner diameter of approximately 0.747 inches. The tube has an outer layer 24 of 14-carat gold alloy approximately 0.003 inches thick, a middle layer 26 of sterling silver approximately 0.008 inches thick, and an inner layer 28 of the 14-carat gold alloy also approximately 0.003 inches thick. The outer surface of outer layer 24 forms the outer surface 16 of the tube, and the inner surface of inner layer 28 forms the inner surface 18 of the tube.

As used herein, the terms "laminated" and "lamination" mean that metal solids of the desired alloy have been bonded together to form a mechanically unitary object but exclude the formation of metal layers by plating a precious metal alloy from a liquid solution onto a tube using today's plating technology. If today's plated flutes are taken as illustrative, it is believed that today's plating technology does not, in a practical sense, provide the advantages of the present invention in economically providing smoothness of outer surface 16 and inner surface 18, thickness or uniformity of thickness of outer layer 24 and inner layer 28, or a work history of iterative drawing followed by annealing of outer layer 24 and inner layer 28.

Figure 3:
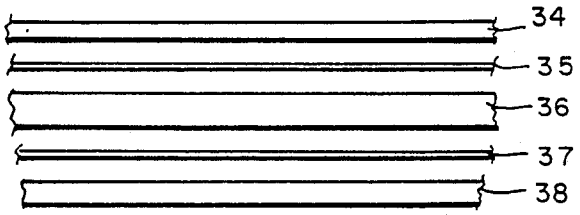
FIG. 3 is an exploded fragmentary view of metal disks which are stacked with their adjacent surfaces in contact at one stage in the manufacture of the flute depicted in FIG. 1.

As an example, the laminated metal tube is made by cupping and drawing a laminated metal disk formed from five uniform metal disks 34 through 38, depicted in FIG. 3. Two disks are stamped from a sheet of 14-carat gold alloy and will become disks 34 and 38 in the stack depicted in exploded, fragmentary view in FIG. 3. One disk 36 is stamped from a sheet of sterling silver, and two disks 35 and 37 are stamped from a sheet of silver solder. All of the disks are approximately 7¼ inches in diameter. The thicknesses of the 14-carat gold alloy and sterling silver sheets (and thus of the disks cut from the sheets) are chosen so that the above-mentioned thicknesses of the layers 24, 26, and 28 in the substantially cylindrical unitary laminated metal tube shown in cross-section in FIG. 2 will be achieved after lamination, cupping, and drawing. The thickness of the silver solder sheet from which silver solder disks 35 and 37 are stamped is chosen so that silver solder disks 35 and 37 will achieve the bonding described below.

As an example, a 14-carat gold alloy sheet from which disks 34 and 38 are formed has a composition of 58.4 per cent gold, 8.28 per cent silver, 32.97 per cent copper, and 0.35 per cent zinc. A sterling silver sheet from which disk 36 is formed has a composition of 92.5 per cent silver and 7.5 per cent copper. A silver solder sheet from which disks 35 and 37 are formed has a composition of 52.2 per cent silver, 38.4 per cent copper, and 9.4 per cent zinc, giving it a solidus point of 1340° F. and a liquidus point of 1375° F.

The disks are then stacked as shown in exploded, fragmentary form in FIG. 3 and heated until the silver solder disks melt to such an extent that the solder from those disks will, when the stack formed from the disks is cooled, bond gold disk 34 to one surface of sterling silver disk 36 and gold disk 38 to the other surface of sterling silver disk 36 to form a mechanically unitary laminated metal disk. In the example given, the five disks are stacked and placed in a furnace (which should have a reducing or neutral atmosphere) preheated to 1300° F., where the disks are heated further until silver solder disks 35 and 37 begin to flow, which takes about one hour. Pressure of about 10 to 15 pounds per square inch is applied by a press inside the furnace to force the stacked disks together to prevent voids from developing between the metal layers. When the silver solder begins to flow, the furnace temperature is reduced until the solder resolidifies, which takes about 10 minutes. At that point the disks are removed from the furnace and air quenched.

Good results are also obtained by using for gold disks 34 and 38 a 14-karat gold alloy having 58.33 per cent gold, 2.08 per cent silver, and 32.59 per cent copper, by using for sterling silver disk 36 an alloy having 92.7 per cent silver and 7.3 per cent copper, and by using for disks 35 and 37 a silver solder having 60.0 per cent silver, 25.0 per cent copper, and 15.0 per cent zinc, giving the solder a solidus point of 1245° F. and a liquidus point of 1325° F.

The mechanically unitary laminated metal disk is then made into the substantially cylindrical tube described above, suitable for use as flute tubing, by the same methods used to make traditional, non-laminated, uniform disks of precious metal alloy into substantially cylindrical tubes for flute tubing. That is, the mechanically unitary laminated disk is formed into a substantially cylindrical shape by ramming the disk into a cup-shaped form and then iteratively repeating the steps of drawing the cup-shaped form and then annealing it to maintain a "soft" and workable hardness of the cup-shaped form and of the substantially cylindrical shape which this process produces. This drawing process also reduces the thickness of the material.

Using this mechanically unitary laminated metal tube, a flute headjoint is made using the same methods used to make a flute headjoint from traditional tubing of non-laminated, uniform precious metal alloy. Although the headjoint is slightly tapered from the substantially cylindrical unitary laminated metal tube, the tapering does not alter the arrangement of the outer, middle, and inner bonded layers 24, 26, and 28 (see FIG. 2), respectively.

All of the tube segments of the flute may be made of the new laminated tubing. However, the new laminated headjoint produces excellent tone quality even when played with a center joint and foot joint having tubing of traditional, uniform gold alloy or silver alloy. This is because the tone of a flute comes largely from the headjoint and, therefore, the headjoint of a flute has a greater effect on the tone quality of a flute than the middle joint or the foot joint. Such flutes having the laminated headjoint project tones well, produce tones easily, and are easy to play since they are not easily "overblown".

Figure 4:
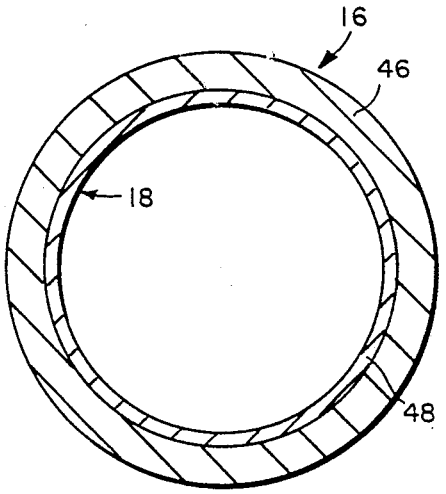
FIG. 4 is a cross-sectional view, similar to the cross-sectional view depicted in FIG. 2, depicting a second embodiment of the invention.

The new flute may also be formed from other mechanically unitary laminated metal tubes. For example, the flute may be formed from a two-layer laminate as depicted in FIG. 4. FIG. 4 depicts a cross-section (similar to that shown in FIG. 2) through a mechanically unitary laminated metal tube for making a headjoint. The tubing shown in FIG. 4 has an outer layer 46 of sterling silver approximately 0.011 inches thick, the outer surface of which forms the outer surface 16 of the unitary laminated metal tube. It also has an inner layer 48 of gold alloy approximately 0.003 inches thick, the inner surface of which forms the inner surface 18 of the unitary laminated metal tube. Such a unitary laminated metal tube could be made by using a sterling silver disk 36, a silver solder disk 37, and a gold alloy disk 38, such as shown in FIG. 3 (without disks 34 and 35) and processing those three disks as described above. The original thicknesses of such disks 36 and 38 would have to be chosen so that, after the cupping and drawing operation, the unitary laminated metal tube would have the thicknesses specified above. Moreover, the cupping and drawing operation would have to be performed so that the layer of sterling silver resulting from disk 36 became the outer layer 46 of the tubing and the layer of gold alloy resulting from disk 38 became the inner layer 48 of the tubing.

Precious metals other than those described above can be used in flute tubing, even though the use of alloys of some of those other metals in flute tubing has not been traditional. As used herein, the term "precious metal" means gold, silver, and the platinum group metals excluding osmium (which are platinum, iridium, palladium, rhodium, and ruthenium), and the term "alloy" includes a precious metal of commercial (such as 24-carat gold) or higher purity.

Moreover, the combination in which alloys of precious metals appear in the layers of the tubing can be other than those mentioned above, the combination of precious metal alloys chosen can be placed in the layers in different orders than those mentioned above, and different alloys of the same precious metal can be used in different layers of the same tubing. For example, but not by way of limitation, in a three-layer flute tubing, such as shown in FIG. 2, the layers could be an alloy of gold (such as 14-carat gold) or of platinum as the outer layer 24, an alloy of gold (such as 18-carat gold) or of platinum as the inner layer 28, and an alloy of silver as the middle layer 26. In a two-layer mechanically unitary laminated flute tubing, such as shown in FIG. 4, either the outer layer 46 or the inner layer 48 could be an alloy of gold, of silver, or of platinum. Moreover, in either a three-layer or a two-layer mechanically unitary laminated flute tubing, the thicknesses of the layers can be different from the thicknesses described above.

It will be apparent to those skilled in the art of making metal flutes that the foregoing examples of combinations of particular alloys of particular precious metals used in particular lamination layers having particular thicknesses need not be, and are not, exhaustive.

In addition, the tone quality of flutes having tubing including even a base metal alloy (such as an alloy of nickel or zinc) can be improved by making the tubing from a unitary laminated metal having a bonded layer of base metal alloy and one or more bonded layers of precious metal alloy.

Moreover, the invention can also be used in connection with other kinds of musical instruments. The invention could be useful for musical instruments, such as bells or chimes, having substantially cylindrical segments, or for the tubes of musical wind instruments, such as piccolos or organ pipes, which also have substantially cylindrical segments. The invention may also be used for the tubes of musical instruments, such as saxophones or trumpets, which do not have substantially cylindrical segments. The invention may be useful whether the tubing in such segments is straight or curved, and whether the tubing in such instruments is all in one segment or is in more than one segment.

The foregoing description has been limited to specific embodiments of the invention. It will be apparent, however, that variations and modifications may be made to the invention, with the attainment of some or all of the advantages of the invention, and that the invention may be made in other ways. Therefore, it is the object of the appended claims to cover all such variations and modifications as come within the true spirit and scope of the invention.

What is claimed as new and desired to be secured by Letters Patent of the United States is:

1. A flute comprising a plurality of generally tubular segments, one of which contains an embouchure plate and breath hole, and at least another of which contains keys and tone holes, the tubular segments having first and second layers, said first layer defining the outer surface of said tubular segment, said second layer defining the inner surface of said tubular segment, said first and second layers being laminated and metallurgically bonded together as a mechanically unitary structure, said first layer comprising an alloy of a first metal, sand said second layer comprising an alloy of a second metal, at least one of said first metal or said second metal being a precious metal.

2. The flute of claim 1, wherein said tubular segment is formed by a process comprising the steps of:

A. metallurgically bonding a first surface of a first sheet of said alloy of said first metal to a first surface of a second sheet of said alloy of said second metal; and B. forming the mechanically unitary structure comprising said first sheet and said second sheet into a tube such that said first layer comprises said first sheet, said second layer comprises said second sheet, the second surface of said first sheet defines said outer surface of said tube, and the second surface of said second sheet defines said inner surface of said tube.

3. The flute of claim 2, wherein the said step of metallurgically bonding said first surface of said first sheet of said alloy of said first metal to said first surface of said second sheet of said alloy of said second metal comprises heating said first sheet of said alloy of said first metal and said second sheet of said alloy of said second metal.

4. The flute of claim 3, wherein the said step of metallurgically bonding said first surface of said first sheet of said alloy of said first metal to said first surface of said second sheet of said alloy of said second metal comprises the steps of:

A. placing a sheet of solder between and in contact with said first surface of said first sheet and said first surface of said second sheet; and B. heating said first sheet of metal, said layer of solder, and said second sheet of metal so that, when said first sheet of metal, said layer of solder, and said second sheet of metal are cooled, said sheet of solder will metallurgically bond said first sheet of metal to said second sheet of metal.

5. The flute of claim 4, wherein said first metal is a precious metal and said second metal is a precious metal.

6. The flute of claim 4, wherein said first metal is silver and said second metal is gold.

7. The flute of claims 4, 5, or 6, wherein said solder comprises a sliver solder.

8. The flute of claims 1, 2, or 3, wherein said first metal is a precious metal and said second metal is a precious metal.

9. The flute of claims 1, 2, or 3, wherein said first metal is silver and said second metal is gold.

10. A flute comprising a a plurality of generally tubular segments, one of which contains an embouchure plate and breath hole, and at least another of which contains keys and tone holes, the tubular segments having first, second, and third layers, said first layer defining the outer surface of said tubular segment, said third layer defining the inner surface of said tubular segment said second layer lying between said first layer and said third layer, said first layer, said second layer, and said third layer being laminated together and metallurgically bonded as a mechanically unitary structure, said first layer comprising an alloy of a first metal, said second layer comprising an alloy of a second metal, and said third layer comprising an alloy of a third metal, at least one of said first metal, said second metal, or said third metal being a precious metal.

11. The flute of claim 10, wherein said tubular segment is formed by a process comprising the steps of:

A. metallurgically bonding a first surface of a first sheet of said alloy of said first metal to a first surface of a second sheet of said alloy of said second metal;

B. metallurgically bonding the second surface of said second sheet of said alloy of said second metal to a first surface of a third sheet of an alloy of said third metal; and C. forming the mechanically unitary structure comprising said first, second, and third sheets into a tube such that said first layer comprises said first sheet, said second layer comprises said second sheet, said third layer comprises said third sheet, the second surface of said first sheet defines said outer surface of said tube, and the second surface of said third sheet defines said inner surface of said tube.

12. The flute of claim 11, wherein said first layer comprises an alloy of gold, said second layer comprises an alloy of silver, and said third layer comprises an alloy of gold, wherein said step of metallurgically bonding said first surface of said first sheet to said first surface of said second sheet comprises placing a first sheet of solder between and in contact with said first surface of said first sheet and said first surface of said second sheet and heating said first sheet of solder so that, when cooled, it will metallurgically bond said first surface of said first sheet to said first surface of said second sheet, and wherein said step of metallurgically bonding said second surface of said second sheet to said first surface of said third sheet comprises placing a second sheet of solder between and in contact with said second surface of said second sheet and said first surface of said third sheet and heating said second sheet of solder so that, when cooled, it will metallurgically bond said second surface of said second sheet to said first surface of said third sheet.

13. The flute of claim 12, wherein said first layer is from approximately 0.002 to approximately 0.004 inches thick, said second layer is from approximately 0.007 to approximately 0.009 inches thick, and said third layer is from approximately 0.002 to approximately 0.004 inches thick.

14. The flute of claim 11, wherein:

A. the said step of metallurgically bonding said first surface of said first sheet of said alloy of said first metal to said first surface of said second sheet of said alloy of said second metal comprises heating said first sheet of said alloy of said first metal and said second sheet of said alloy of said second metal; and B. the step of metallurgically bonding said second surface of said second sheet of said alloy of said second metal to said first surface of said third sheet of said alloy of said third metal comprises heating said second sheet of said alloy of said second metal and said third sheet of said alloy of said third metal.

15. The flute of claims 10, 4 or 14, wherein said first metal is a precious metal, said second metal is a precious metal, and said third metal is a precious metal.

16. The flute of claims 10, 11 or 14, wherein said first metal and said third metal are gold, and said second metal is silver.

17. The flute of claim 11, wherein the said step of metallurgically bonding said first surface of said first sheet of said alloy of said first metal to said first surface of said second sheet of said alloy of said second metal comprises the steps of:

A. placing a first sheet of solder between and in contact with said first surface of said first sheet and said first surface of said second sheet; and B. heating said first sheet of metal, said first sheet of solder, and said second sheet of metal so that, when said first sheet of metal, said first sheet of solder, and said second sheet of metal are cooled, said first sheet of solder will metallurgically bond said first sheet of metal to said second sheet of metal; and wherein the said step of metallurgically bonding said second surface of said second sheet of said alloy of said second metal to said first surface of said third sheet of said alloy of said third metal comprises the steps of:

A. placing a second sheet of solder between and in contact with said second surface of said second sheet and said first surface of said third sheet, and B. heating said second sheet of metal, said second sheet of solder, and said third sheet of metal so that, when said second sheet of metal, said second sheet of solder, and said third sheet of metal are cooled, said second sheet of solder will metallurgically bond said second sheet of metal to said third sheet of metal.

18. The flute of claim 17, wherein said first metal is a precious metal, said second metal is a precious metal, and said third metal is a precious metal.

19. The flute of claim 17, wherein said first metal and said third metal are gold, and said second metal is silver.

20. The flute of claims 11, 17, 18, or 19, wherein said first sheet of solder comprises a silver solder.

21. The flute of claim 11, 17, 18, or 19, wherein said second sheet of solder comprises a silver solder.

* * * * *